US006938706B2

(12) United States Patent
Ng

(10) Patent No.: US 6,938,706 B2
(45) Date of Patent: Sep. 6, 2005

(54) POWER TOOL PROVIDED WITH A LOCKING MECHANISM

(75) Inventor: Koon Yuen Ng, Kowloon (HK)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/447,982

(22) Filed: May 29, 2003

(65) Prior Publication Data

US 2004/0069512 A1 Apr. 15, 2004

(30) Foreign Application Priority Data

Jun. 7, 2002 (GB) ..... 0213038
Aug. 2, 2002 (GB) ..... 0217999

(51) Int. Cl.[7] ..... E21B 3/00

(52) U.S. Cl. ..... 173/216; 173/20; 173/39; 173/42; 173/170; 227/8

(58) Field of Search ..... 173/117, 170, 173/216, 217, 20; 310/47, 50; 227/2, 8, 120, 156

(56) References Cited

U.S. PATENT DOCUMENTS 1,144,907 A * 6/1915 Knipple ..... 81/177.9
1,649,060 A 11/1927 Decker
3,571,874 A * 3/1971 Von Arz ..... 29/81.14
4,577,986 A * 3/1986 Wang ..... 403/93
4,907,476 A 3/1990 Singleton
5,265,969 A * 11/1993 Chuang ..... 403/94
5,515,754 A * 5/1996 Elkins ..... 81/177.9
5,533,581 A 7/1996 Barth et al.
5,737,982 A * 4/1998 Lin ..... 81/58.3
6,000,302 A * 12/1999 Chiang ..... 81/177.8
6,102,134 A * 8/2000 Alsruhe ..... 173/217
6,308,599 B1 * 10/2001 Fu-Hui ..... 81/490
6,364,033 B1 * 4/2002 Hung et al. ..... 173/217
6,386,075 B1 * 5/2002 Shiao ..... 81/177.8
6,405,620 B2 * 6/2002 Liao ..... 81/177.7

FOREIGN PATENT DOCUMENTS

DE 36 02 992 A 8/1987
EP 0 691 185 A1 1/1996

* cited by examiner

*Primary Examiner*—Stephen F. Gerrity
*Assistant Examiner*—Thanh Truong
(74) *Attorney, Agent, or Firm*—Harness, Dickey & Pierce, P.L.C.

(57) ABSTRACT

A power tool (2) has a first body (6), a second body (4) connected to the first body (6), and a locking mechanism. One of the bodies (4;6) is moveable with respect to the other body (4;6). The locking mechanism is capable of locking the movement of the one body (4;6) with respect to the other body (4;6). The locking mechanism is a two part system having a first part, a locking member (119), and a second part, receiving member (82). Engagement between the first part and the second part locks the first body (6) and the second body (4) against movement with respect to each other. One part is moveable with respect to the other part between a first position and a second position. The first part and the second part are engaged when the one part is in the first position. The first part and the second part are disengaged when the one part is in the second position. At least one of the parts is shaped to cause play between the two parts of the locking mechanism to be taken up when the one part moves into the first position.

10 Claims, 14 Drawing Sheets

PRIOR ART

POWER TOOL PROVIDED WITH A LOCKING MECHANISM

The present invention relates to power tools and, in particular, to a power tool provided with a locking mechanism for locking and unlocking movement of one portion of the power tool with respect to another portion of the power tool.

An example of a power tool is shown in FIG. 1. The power tool is a drill-driver comprising a body having a drill head and a handle joined at approximately right-angle to the drill head. The drill head encapsulates an electric motor and a gearbox and the combination of the handle and the drill head defines a conventional pistol grip to be grasped by the user. The handle comprises a variable speed trigger switch for low-speed rotary output in screw driving mode or high-speed rotary output in drilling mode. This design of drill-driver is well suited to drilling and screw driving, provided that the workpiece is easily accessible. However, if the hole to be drilled, or the screw to be fastened, is in a tight corner or an awkward position then this design of drill-driver cannot gain access. In this case the user will need to resort to a smaller hand operated drill or a hand tool screwdriver to perform the task in hand.

Utilage of a drill-driver may be improved by inclusion of a pivotable drill head which enables the configuration of the drill-driver to be adapted according to the task in hand. An example of this is seen in German utility model no. 8505814.9 which discloses an electric drill having a drill head and a handle. The drill head comprises an electric motor coupled to a gearbox. The gearbox includes a rotary output protruding from the front end of the drill head. The handle comprises an on/off trigger switch and a battery pack. A flange extension attached to the rear end of the drill head is pivotally coupled to the top end of the handle. The drill head can be pivotally adjusted with respect to the handle through an arc of 90°, between a position where the drill head is perpendicular to the handle and another position where the drill head is in-line with the handle. However, one of the drawbacks of the drill driver disclosed by German Utility Model 8505814.9 is that it lacks a locking mechanism for locking the drill head against pivotal movement relative to the handle when so desired.

An example of a pneumatic power tool with a handle portion and a pivotable head portion is disclosed by German patent publication no. DE3602992. The head portion can be pivoted relative to the handle portion through an arc of 45°. The power tool has a locking mechanism for locking the head portion against pivotal movement in any one of three angular orientations. The locking mechanism comprises a locking pin located in a channel in the handle portion. The locking pin is operated by a button. The locking mechanism further comprises three indexing holes located on the head portion, each indexing hole corresponding to a respective angular orientation of the head portion relative to the head portion. A spring biases the pin into engagement with the indexing holes. Engagement between the pin and any one of the indexing holes locks the head portion against pivotal movement relative to the handle portion. This prevents unintentional pivotal movement of the head portion. Conversely, operation of the button against the bias of the spring disengages the pin from the indexing holes to permit pivotal movement of the head portion of relative to the handle portion. Notably, this design of locking mechanism needs some degree of clearance, or play, between the pin and the walls of the channel in which the pin slides, as well as between the pin and the sides of the indexing holes, otherwise free sliding movement of the pin throughout its travel would be difficult. The presence of clearance, or play, and around the pin permits a certain degree of movement of the head portion relative to the handle portion, even when the pin fully engages the one of the indexing holes. This is an undesirable feature for some power tools.

It is an object of the present invention to provide a power tool of type described at the outset, in which the disadvantages of having a locking mechanism which, even when fully engaged, always permits some degree of movement of one body portion relative to another body portion are avoided, or at least reduced.

Accordingly a power tool is provided which comprises a first body, a second body connected to the first body, and a locking mechansim, wherein one body is moveable with respect to the other body, and the locking mechanism is capable of locking the movement of the one body with respect to the other body, the locking mechanism comprising a two part system having a first part comprising a locking member and a second part comprising a receiving member, whereby engagement between the first part and the second part locks the first body and second body against movement with respect to each other, and wherein one part is moveable with respect to the other part between a first position and a second position, such that the first part and the second part are engaged when that one part is in the first position, and the first part and the second part are disengaged when that one part is in the second position, characterised in that at least one of the parts is shaped to cause take up of play between the two parts of the locking mechanism when that one part moves into the first position. The first body may be directly connected to the second body, or, alternatively, the first body may be connected to the second body via one or more intermediate members.

Preferably one body is rotatable with respect to the other body about a pivot axis.

Preferably the locking member comprises a left finger with a left ramp face for engagement with the receiving member, and the locking member further comprises a right finger with a right ramp face for engagement with the receiving member, and wherein the ramp faces are inclined with respect to the receiving member such that the movement of that one part into the first position takes up play between the left ramp face and the receiving member, and the movement of that one part into the first position takes up play between the right ramp face and the receiving member.

Preferably the left finger is arranged in a left channel and the right finger is arranged in a right channel, such that the movement of that one part into the first position wedges the left finger between the receiving member and a wall of the left channel, and the movement of that one part into the first position wedges the right finger between the receiving member and a wall of the right channel. The wedging action of the left and right fingers reduces, or virtually eliminates, play between the walls of the channels, the fingers, and the receiving member. Also, the wedging action at the interface between the left finger and the receiving member creates a force equal to, and opposite to, the force created by the wedging action at the interface between right finger and the receiving member. Accordingly, the wedging action of the left and right fingers provides the advantage of firmly locking the first body with respect to the second body so that movement of the first body with respect to the second body is reduced, or virtually eliminated.

Preferably the left and right channels are fixed to the first body, and the receiving member is fixed to the second body. The left and right channels may be part of the first body, or, alternatively, the left and right channels may be part of a member fixed to the first body.

Preferably the left finger moves in the left channel between the first position and the second position, and the right finger moves in the right channel between the first position and the second position.

Preferably the left and right fingers are biased towards the first position by a respective resilient member. This provides the advantage that the locking mechanism normally locks the first body against movement relative to the second body without need for a catch or latch to maintain this status.

Preferably the receiving member is a wheel having the pivot axis. Accordingly, the ramp face of the left finger can engage the left side of the wheel to prevent clockwise rotation of the second body with respect to the first body, and the ramp face of the right finger can engage the right side of the wheel to prevent anti-clockwise rotation of the second body.

More preferably, the wheel is a toothed wheel with a plurality of teeth arranged about the circumference of the toothed wheel for engagement with the ramp faces. The plurality of teeth on the toothed wheel provides the advantage that the locking mechanism can firmly lock the first body in a plurality of indexed angular orientations with respect to the second body.

Preferably the locking mechanism further comprises a button coupled to the left and right fingers. The button can be operated by the user to move the locking member against the bias of the resilient members. Alternatively, in the case where there are no resilient members, the button can be operated by the user to move the locking member to lock and unlock movement of the first body with respect to the second body.

A preferred embodiment of the present invention will now be described by way of example only, with reference to the accompanying illustrative drawings in which.

Figure 1:
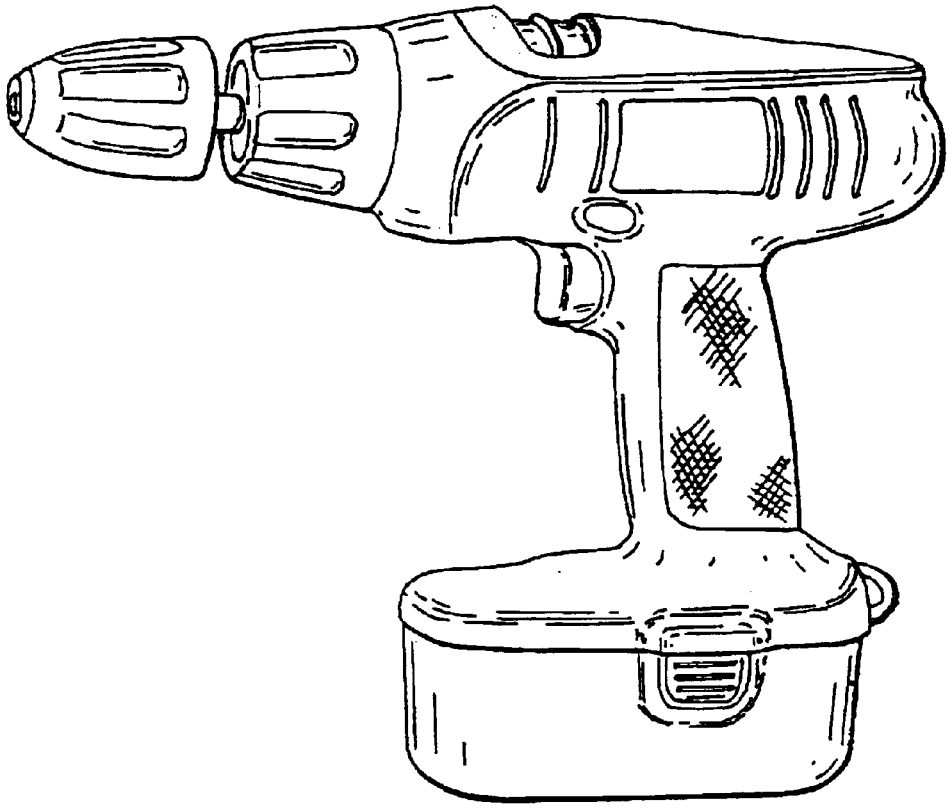
FIG. 1 shows a conventional pistol grip drill-driver.
Figure 2:
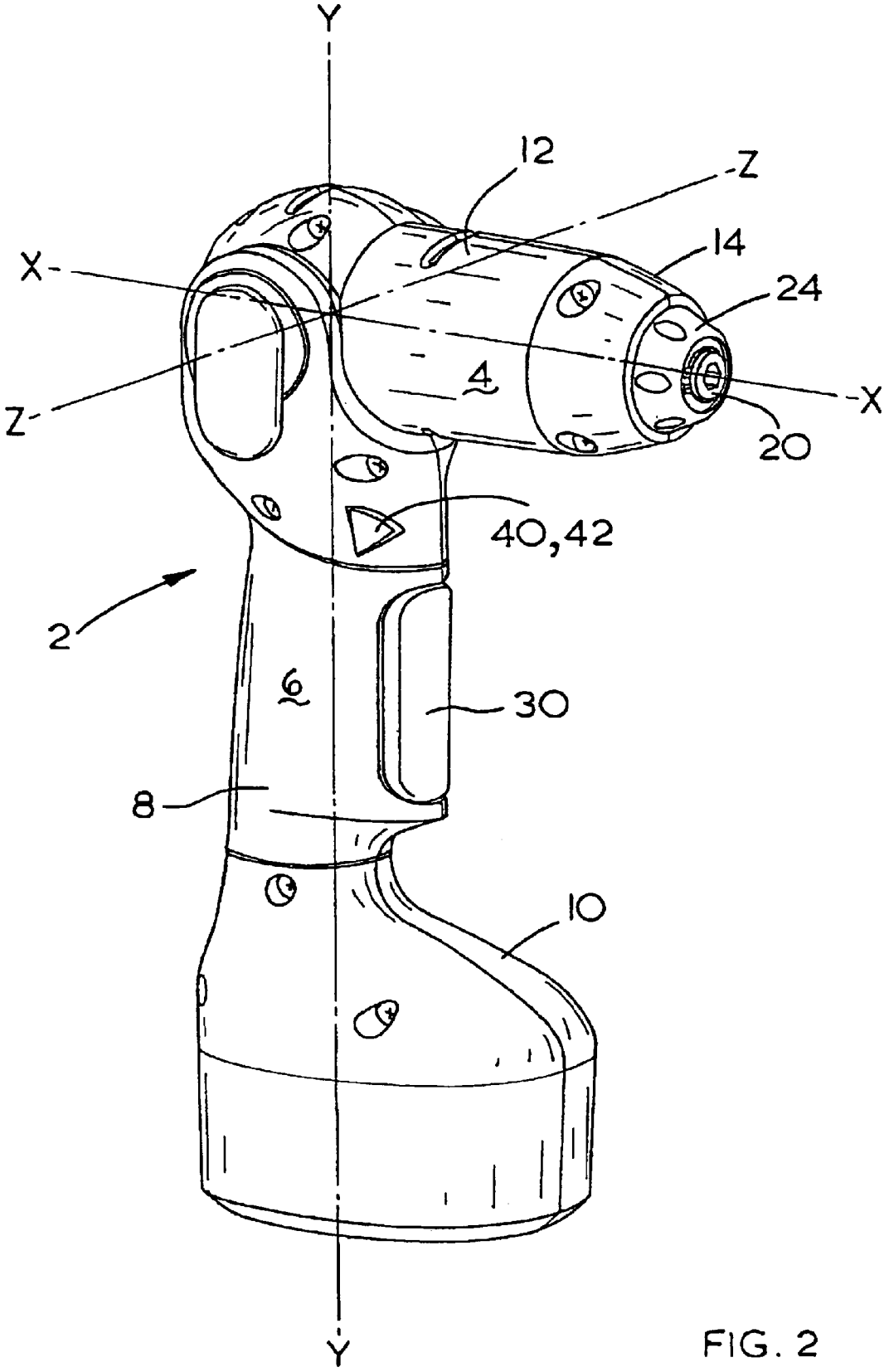
FIG. 2 shows a side perspective view of the power tool.
Figure 3:
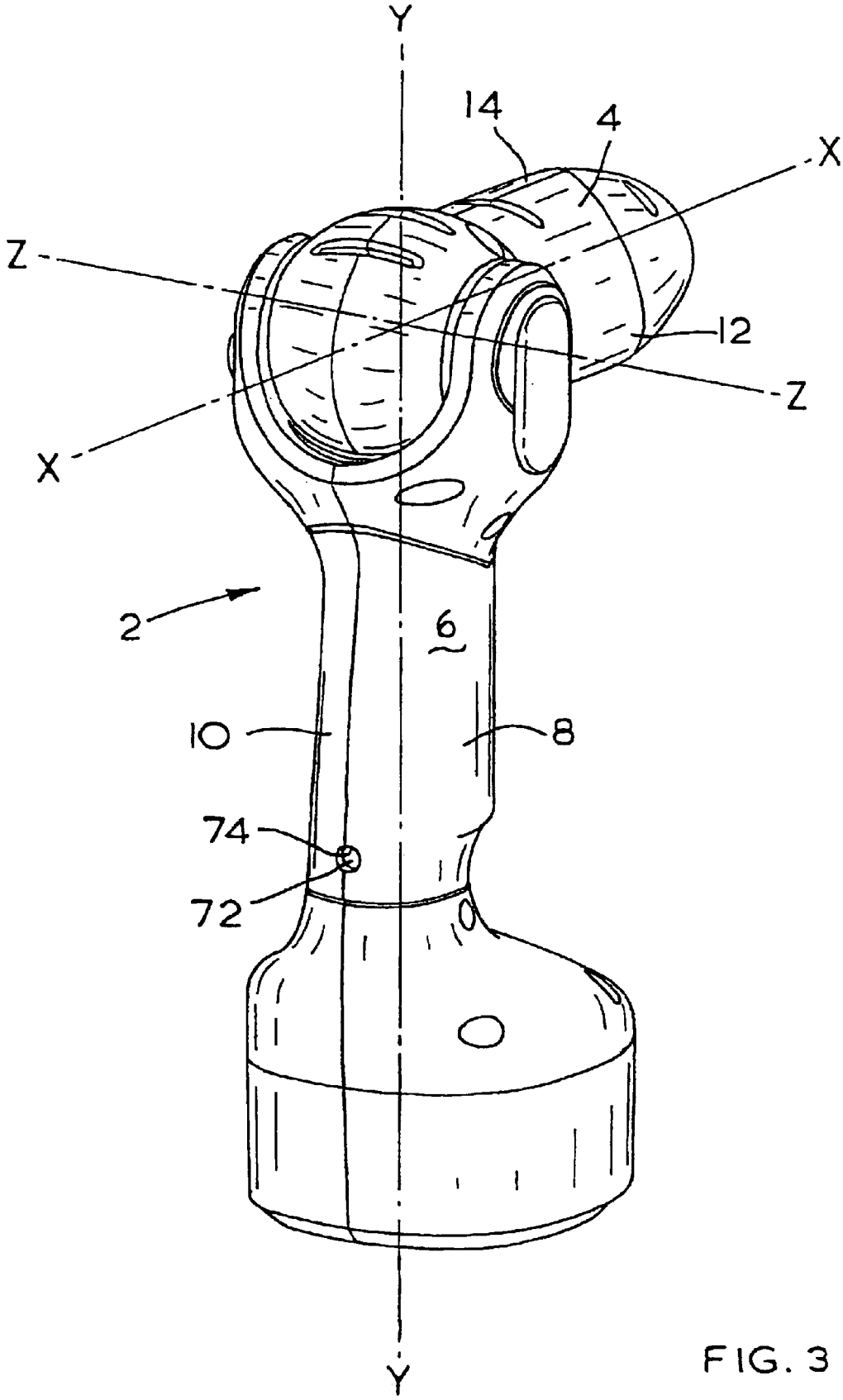
FIG. 3 shows a rear perspective view of the power tool.

Referring now to FIGS. 2 and 3, a power tool shown generally as 2 is a drill-driver comprising a substantially cylindrical drill head 4 having a longitudinal axis X and an elongate handle 6 arranged about a longitudinal axis Y. The drill head 4 is pivotally mounted upon the handle 6 and pivots relative to the handle 6 about an axis Z. The handle 6 is formed by a first clamshell 8 and a second clamshell 10 which are joined together by a plurality of screws not shown. The drill head 4 is formed by a third clamshell 12 and a fourth clamshell 14 which are joined together by a plurality of screws not shown.

Figure 4:
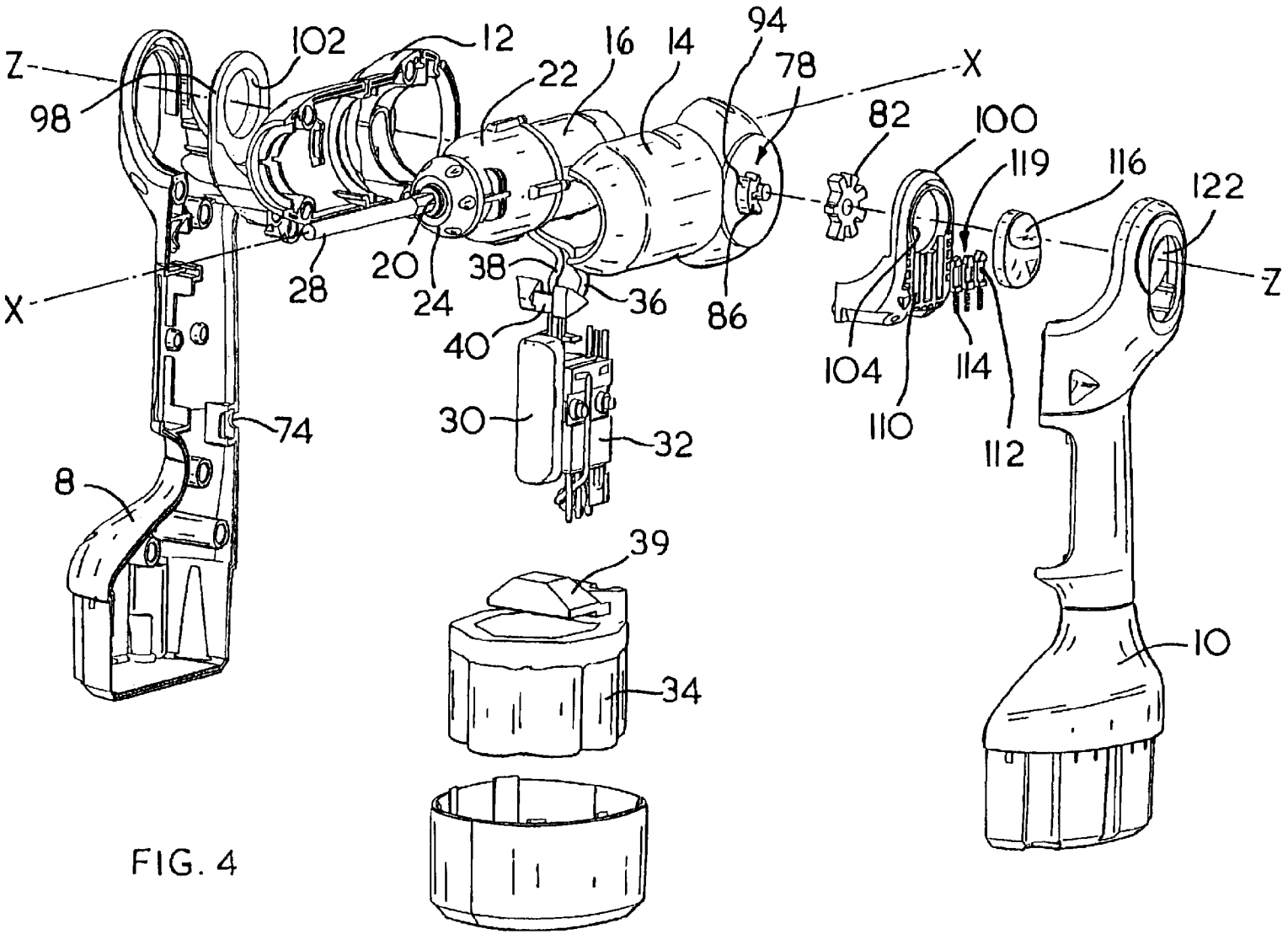
FIG. 4 shows an exploded perspective view of one side of the power tool.
Figure 5:
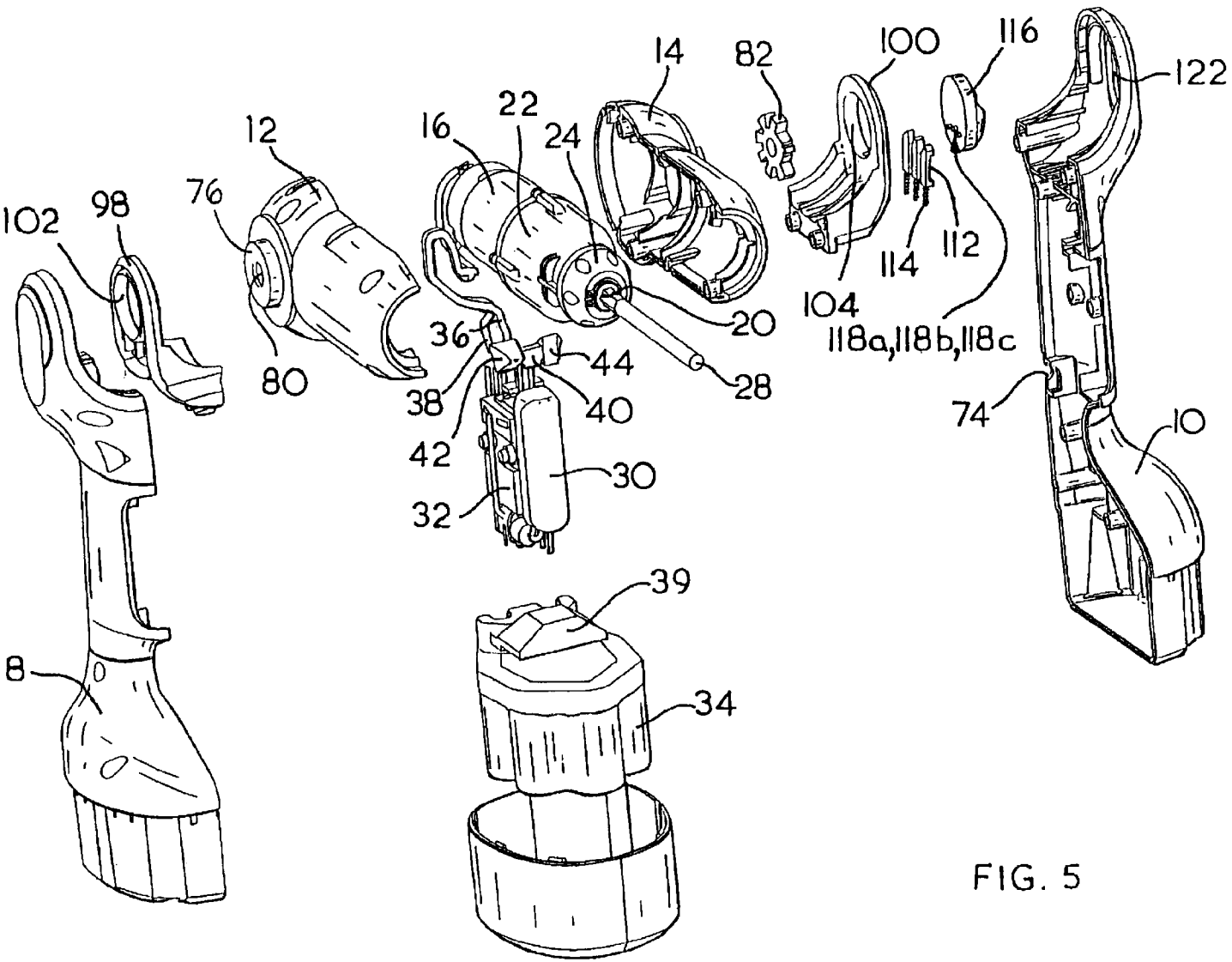
FIG. 5 shows an exploded perspective view of the other side of the power tool to that shown in FIG. 4.

Referring to FIGS. 4 and 5, the drill head 4 comprises an electric motor 16 and a transmission gearbox not shown with an output spindle 20. The motor 16 and the gearbox are housed inside the drill head 4. The front end of the drill head 4 comprises a cylindrical gear casing 22 surrounding the gearbox and the output spindle 20. The motor 16 is rotatingly coupled to the gearbox such that rotary motion of the motor 16 is transferred to the output spindle 20 via the gearbox. The end portion of the output spindle 20 has a hex drive coupling 24 attached thereto. The output spindle 20 and the coupling 24 protrude through a hole 26 in the gear casing 22. The output spindle 20 and the coupling 24 rotate about the axis x. The coupling 24 releasably connects the output spindle 20 to a tool 28 having a conventional hexagonal shank arrangement. Equally, another type of coupling like, for example, a conventional chuck can be attached to the end portion of the output spindle 20 for connection to a tool 28.

The handle 6 comprises a button 30 fixed to a variable speed electrical switch 32. The switch 32 is electrically coupled to a power source 34. The switch 32 is also electrically coupled to the motor 16 by two electrical wires 36,38. The switch 32 is thermally coupled to a heat sink 39 located inside the handle 6. The heat sink 39 is for dissipating excess heat energy created by the internal components of the switch 32. The switch 32 is biased into an OFF position wherein the switch 32 interrupts electrical connection between the power source 38 and the motor 16 such that the motor 16 is denergised and the output spindle 20 does not rotate. Depression of the button 30 moves the switch 32 to an ON position wherein the switch 32 makes electrical connection between the power source 34 and the motor 16. The motor 20 is energised by the electrical current from the power source 34 and the output spindle 20 starts to rotate. Electrical current flowing from the power source 34 to the motor 16 is thus controlled by the switch 32 and is proportional to how far the button 30 is depressed. As depression of the button 30 increases so does flow of electrical current to the motor 16 causing a corresponding increase in the rotational speed of the output spindle 20, and vice versa. When the button 30 is released the switch 32 returns to the OFF position to interrupt the electrical connection between the power source 34 and the motor 16 thus causing denergision of the motor 16.

Figure 6:
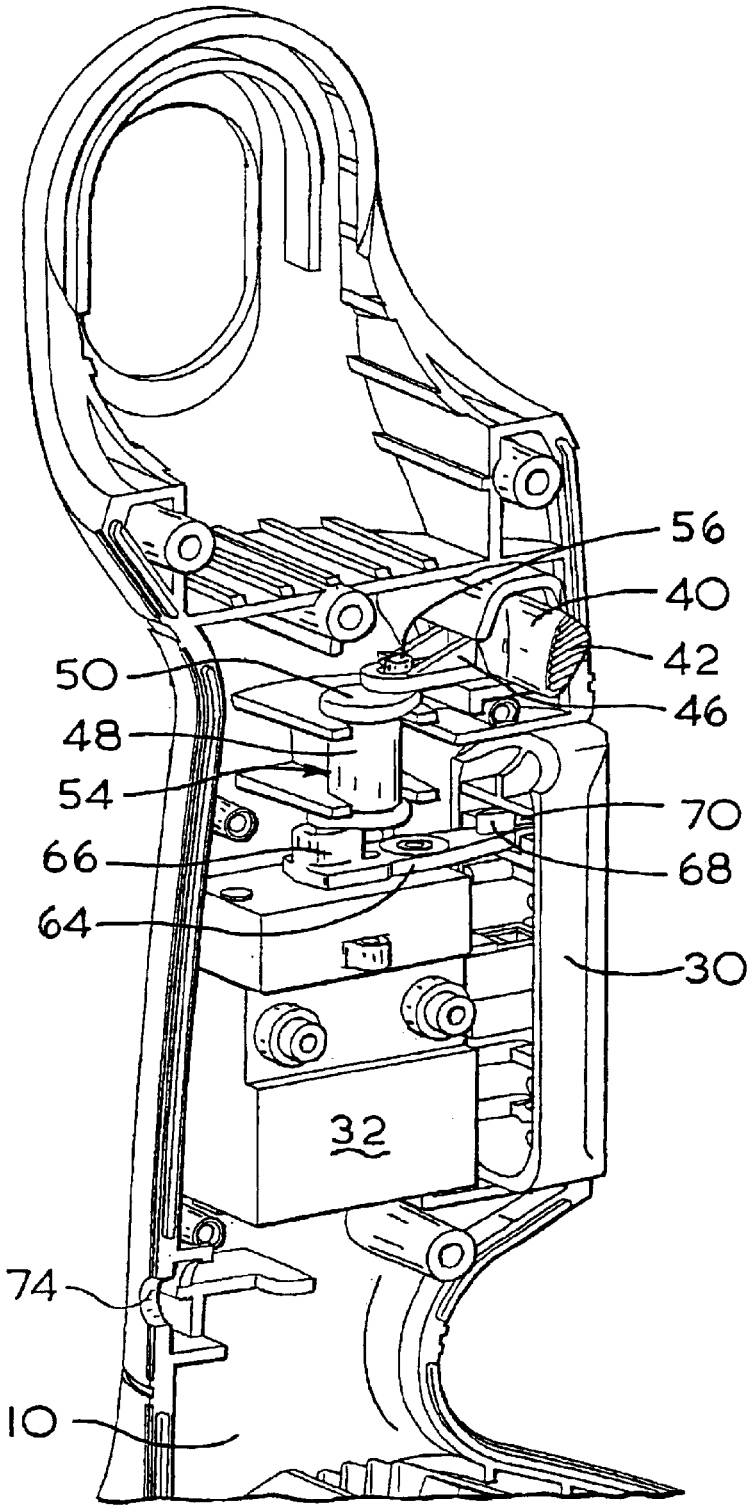
FIG. 6 shows a detailed view of the switch and the direction selector.
Figure 7:
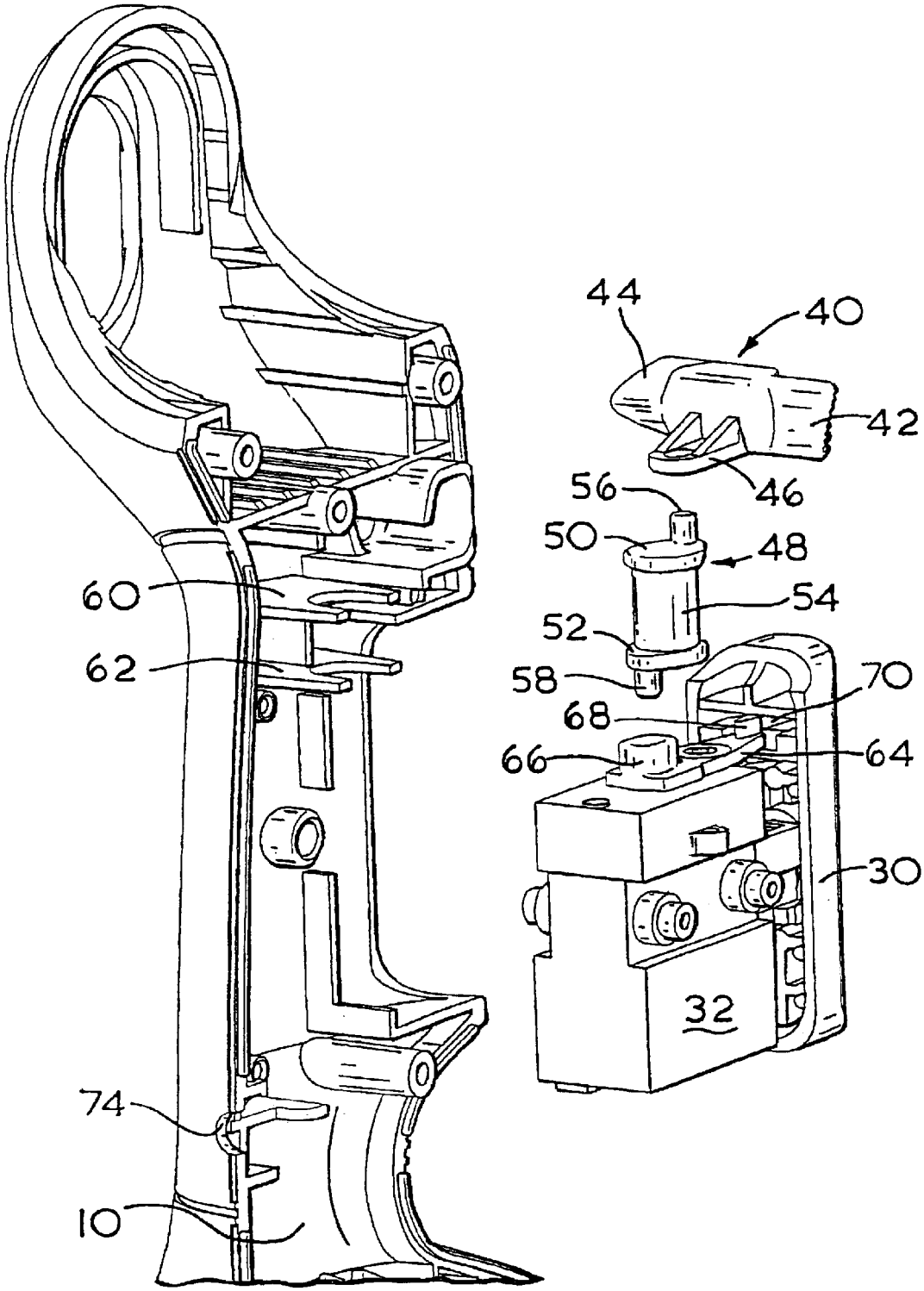
FIG. 7 shows an exploded view of the switch and the direction selector.

Referring to FIGS. 6 and 7, the handle 6 comprises a direction selector 40 for selecting the rotational direction of the motor 16 and the output spindle 20. The direction selector 40 is approximately T-shaped and comprises a forward button 42 on one side, a reverse button 44 on the other side, and a flange 46 in the middle. To support the direction selector 40 the forward 42 and reverse 44 buttons partially protrude through an aperture in each of the first 8 and second 10 clamshells respectively. The handle also comprises a barrel 48 with an upper flange 50, a lower flange 52 and a central cylinder 54 located between the upper and lower flanges 52,54. The barrel's flanges 50,52 each have a mainly circular circumference part which is interrupted by a protruding part and are shaped like a tear-drop. The circular part of upper and lower flanges 50,52 has a diameter greater than the central cylinder 54. The protruding part of the upper flange 50 has an upper spigot 56. The protruding part of the lower flange 54 has a lower spigot 58. The upper and lower spigots 56,58 are eccentric with respect the axis of the central cylinder 54 and point axially away from the central cylinder 54. The barrel 48 is supported for pivotal rotation by a pair of brackets 60,62 which are moulded into interior of the handle's clamshells 8,10. The brackets 60,62 surround the central cylinder 54 to support the barrel 48 against lateral movement. The brackets 60,62 abut the inner faces of the upper and lower flanges 50,52 to support the barrel 48 against axial movement. The handle 6 further comprises an arm 64 with a hollow cylindrical hub 66 at one end and a finger 68 at the other end. The arm 64 is pivotally coupled to the internal components of the switch 32 at a point midway between the hub 66 and the finger 68. The arm 64 can pivot between a forward position, a central position and a reverse position. Pivotal movement of the arm 64 from its forward position to its reverse position, and vice versa, causes the switch 32 to change the polarity of the electrical wires 36,38, as explained in more detail below.

The direction selector 40 is mechanically coupled to the switch 32 via the barrel 48 and the arm 64 in the following manner. The barrel's upper spigot 56 engages the direction selector 40 by protruding through a hole in the flange 46. The barrel's lower spigot 58 is seated within the arm's hollow cylindrical hub 66 in the manner of a trunnion arrangement. As such, depression of the forward button 42 slides the direction selector 40 and the upper spigot 56 in one direction thereby rotating the barrel 48 about its axis. Rotation of the barrel 48 moves the lower spigot 58 in the opposite direction thereby pivoting the arm 64 into its forward position. Depression of the reverse button 44 reverses this sequence and causes the arm 64 to pivot from its forward position to its reverse position.

When the arm 64 is in its forward position the polarity of the wires 36,38 causes the motor 16 to turn the output spindle 20 in a clockwise direction when the switch 32 is in the ON position. When the arm 64 in its reverse position the polarity of the wires 36,38 is reversed and the motor 16 to turns the output spindle 20 in an anti-clockwise direction when the switch 32 is in the ON position. When the arm 64 is in its central position the arm's finger 68 is aligned with and abuts a central stop 70 on the interior of the button 30 thereby preventing depression of the button 30 and locking the switch 32 in the OFF position.

The direction selector's buttons 42,44 are arrow-head shaped. The apex of the forward button 42 points forward to give the user a visual and tangible indication that depression of the forward button 42 causes the output spindle 20 to rotate in a clockwise direction i.e. the rotational direction causing a screw or drill bit to be driven "forward" into a work piece when the switch 32 is in the ON position. Conversely, the apex of the reverse button 44 points backward to give the user a visual and tangible indication that depression of the reverse button 42 causes the output spindle 20 to rotate in an anti-clockwise direction when the switch 32 is in the ON position.

The power source is a rechargeable battery pack 34 housed inside the bottom of the handle 6. To improve the electrical charge of the battery pack 34, thereby increasing operating life, the battery pack 34 is relatively bulky causing the handle 6 to protrude on the side of the switch button 30. The battery pack 34 is electrically coupled to a battery recharger socket 72 located at the lower end of the handle 6. The battery recharger socket 72 protrudes through a small aperture 74 in the handle 6 to provide an electrical link between the battery pack 34 and an external battery recharging source not shown. Alternatively, the power source may be a rechargeable battery detachably fixed to the handle 6, or a mains electrical supply.

Returning to FIGS. 4 and 5, the drill head 4 has a first cylindrical hub 76 and a second cylindrical hub 78 both located part way along the length of the drill head 4, remote from the output spindle 20. The first and second hubs 76,78 are located on opposite sides of the drill head 4. The first and second hubs 76, 78 are substantially the same diameter and both arranged about axis Z. The first and second hubs 76, 78 extend from the drill head 4 in diametrically opposed directions along axis Z. Axis Z is perpendicular to axis's X and Y.

Figure 8:
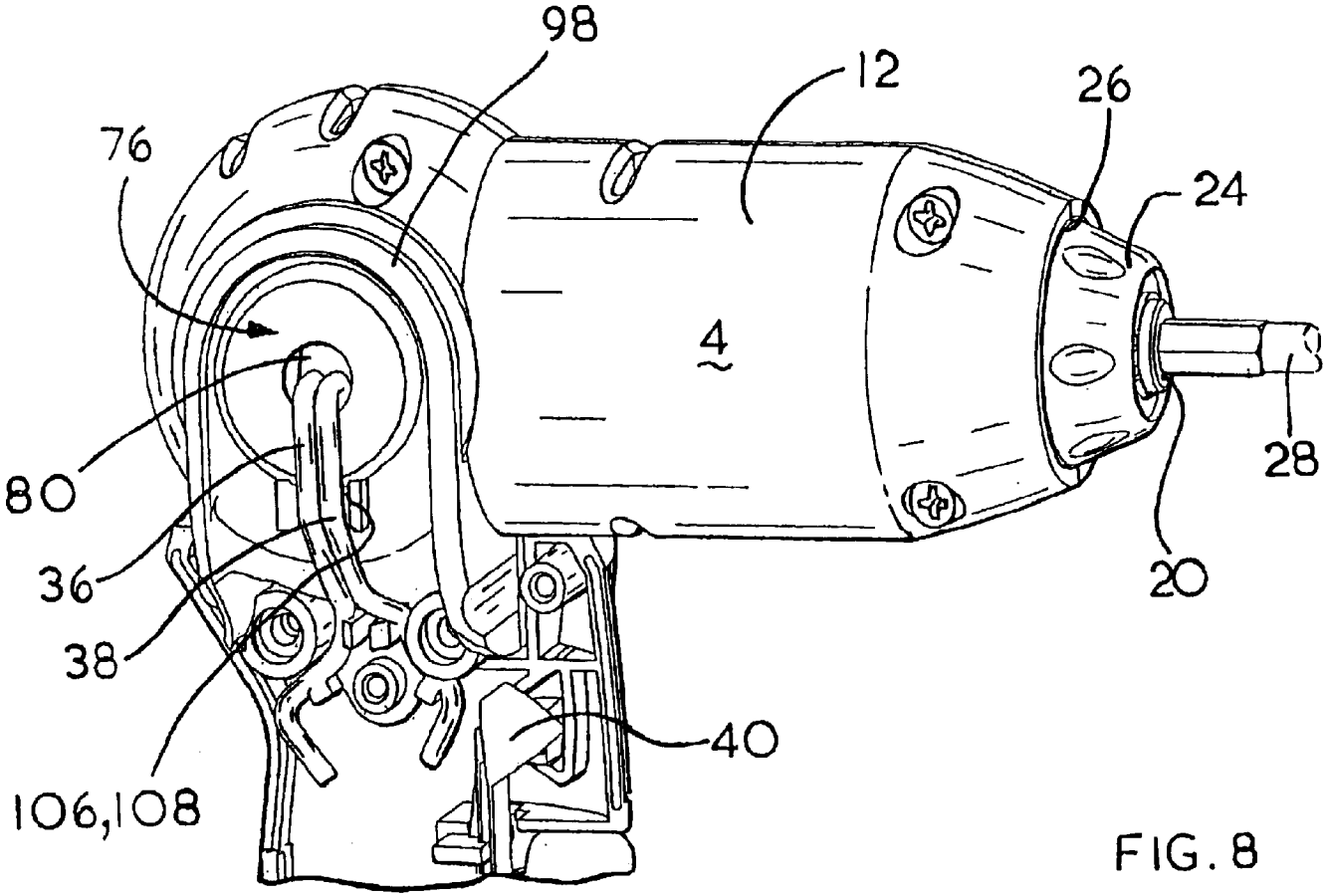
FIG. 8 shows a side cut-away view of the entry point of electrical wires into the drill head.

Referring to FIG. 8, the first cylindrical hub 76 is moulded into the third clam shell 12 of the drill head 4. The first cylindrical hub 76 comprises a central inner aperture 80 co-axial with axis Z. The inner aperture 80 provides an entry point to the interior of the drill head 4.

Figure 9:
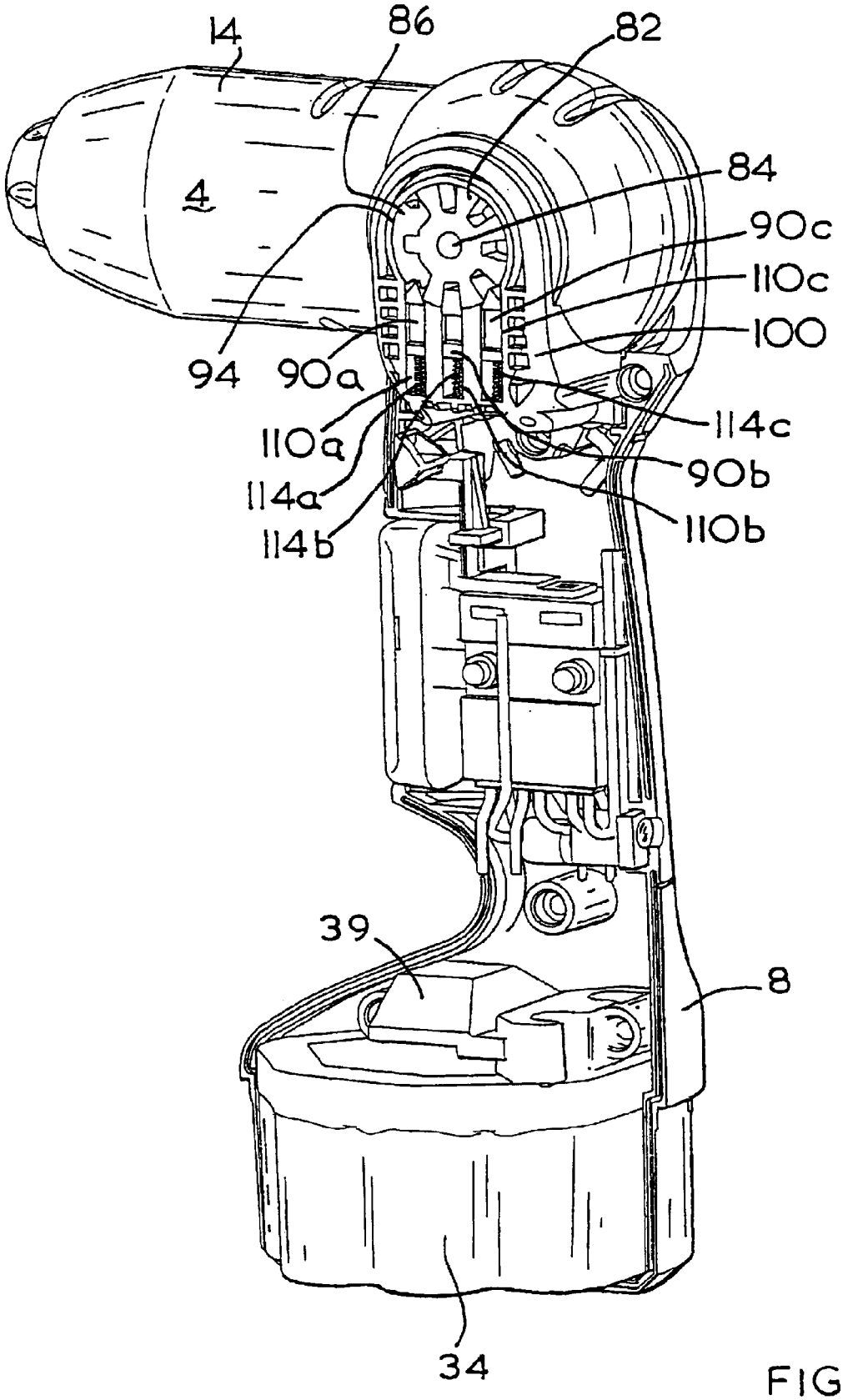
FIG. 9 shows a side cut-away view one side of the power tool.
Figure 10:
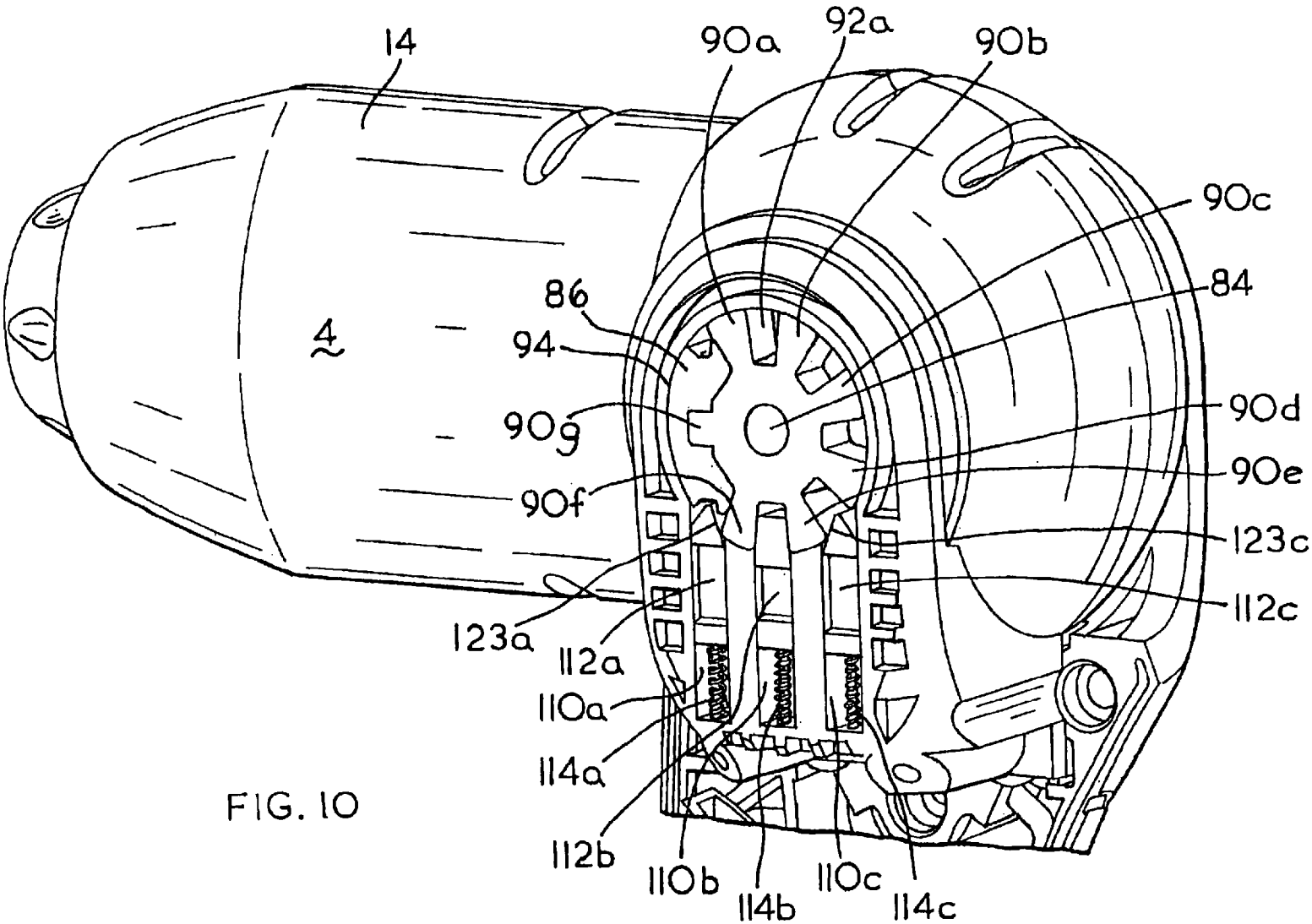
FIG. 10 shows a side cut-away view of the locking mechanism of the power tool in a locked position.
Figure 11:
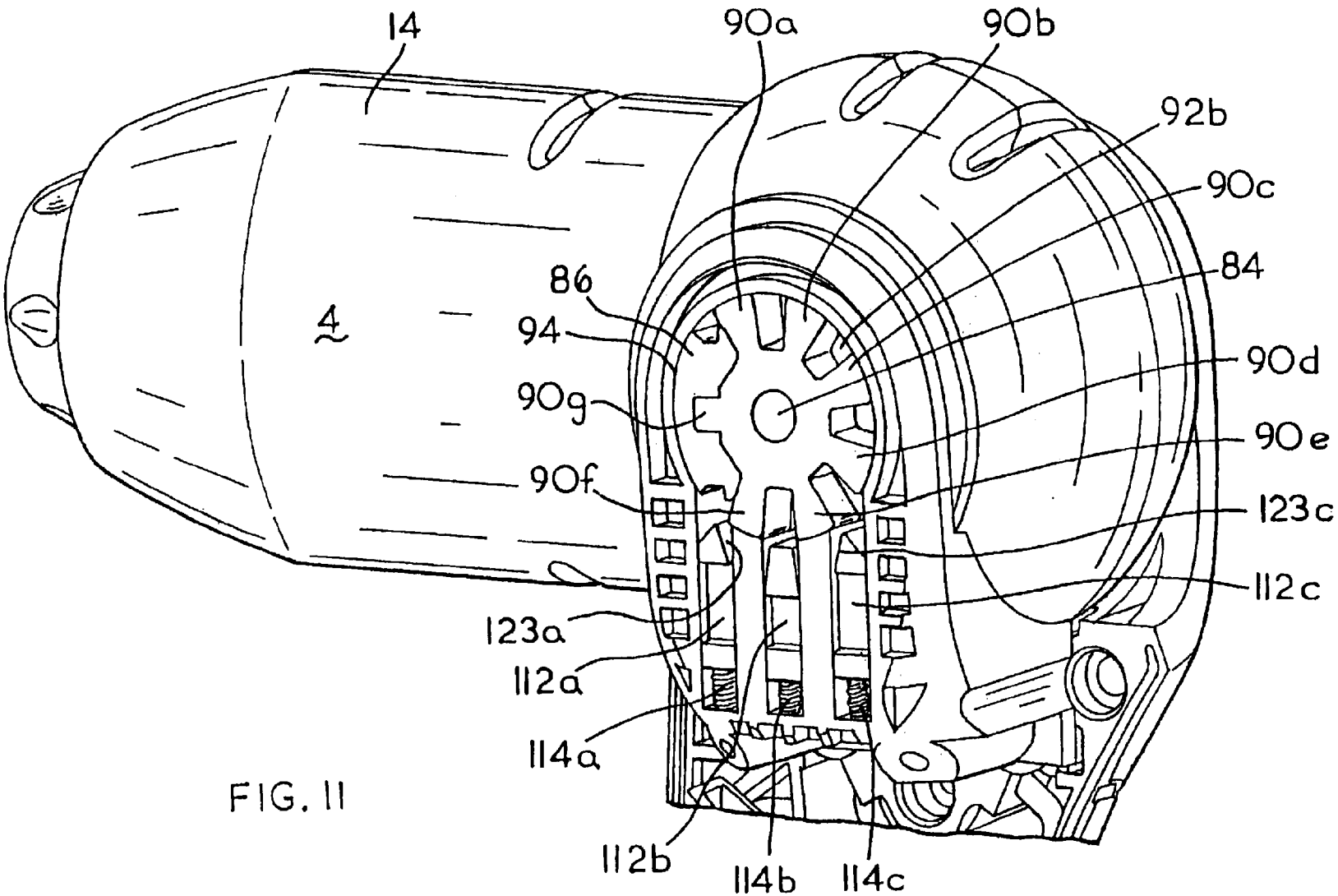
FIG. 11 shows a side cut-away view of the locking mechanism of the power tool in an unlocked position.

Referring to FIGS. 9, 10 and 11, the second hub 78 comprises a circular toothed wheel 82 and a cylindrical spigot 84 both having axis Z, and a protrusion 86. The protrusion 86 and the spigot 84 are moulded into the fourth clam shell 14 of the drill head 4. The wheel 82 comprises a central aperture 88 also having axis Z, and seven teeth 90*a*–90*g* extending radially about the wheel 82. The seven teeth 90*a*–90*g* of the toothed wheel 82 are juxtaposed by seven recesses 92*a*–92*g*. Six teeth 90*a*–90*f* are arranged at 45° intervals about the axis Z and the seventh tooth 90*g* is arranged half way between the first tooth 90*a* and the sixth tooth 90*f*. The wheel 82 is fixed to the fourth clam shell 14 by interference fit between the circumference of the aperture 88 and the spigot 84 protruding therethrough. The tips of the six teeth 90*a*–90*f* describe the outer circumference of the wheel 82. The seventh tooth 90*g* is shorter than the other six teeth 90*a*–90*f*. The protrusion 86 has a curved exterior face 94 corresponding to the outer circumference of the wheel 82. The protrusion 86 also has an irregular interior face 96 shaped to surround the seventh tooth 90*g* and partially occupy two recesses 92*f* and 92*g* in order to fix the wheel 82 against rotation relative to the drill head 4. The curved exterior face 94 of the protrusion 86 and the tips of the teeth 90*a*–90*f* collectively describe the outer circumference of the second hub 78. The wheel 82 is made of steel. Alternatively, the wheel 82 may be made of another suitable hard material.

Returning again to FIGS. 4 and 5, located at the top end of the handle 6 opposite end to the battery pack is a first supporting bracket 98 and a second supporting bracket 100 each shaped to nest in the interior of the first and the second clamshells 8,10 of the handle 6, respectively. The first bracket 98 has a circular aperture 102 for receiving the first hub 76. The second bracket 100 has a circular aperture 104 for receiving the second hub 78. The first and second hubs 76,78, the first and second bracket apertures 102,104, the first hub aperture 80 and the spigot 84 are co-axial having axis Z. The first and second bracket apertures 102,104 act as a yoke in which the first and second hubs 76,78 are supported for pivotal rotation relative to the handle 6. As such, the first and second bracket apertures 102,104 provide pivotal support to the first and second hubs 76,78, respectively, to allow the drill head 4 to pivot relative the handle 6 about axis Z.

Returning to FIG. 8, the first support bracket 98 has a first walled recess 106 facing the interior of the first clam shell 8 of the handle 6. A cavity 108 bounded by the walled recess 106 and the interior of the first clam shell 8 is formed therebetween. The cavity 108 provides a connecting passageway from the interior of the handle 6 to first hub 76 for the wires 36,38. Accordingly, the wires 36,38 travel from the switch 32 via the cavity 108 through the first hub's aperture 80 to the motor 20 inside the drill head 4.

Returning to FIGS. 9, 10 and 11, the second support bracket 100 has three recessed channels 110*a*,110*b*,110*c* adjacent the interior of the first clam shell 10 of the handle 6. Viewed from the side shown in FIG. 9, the left channel 110*a* houses a left finger 112*a* and a helical spring 114*a*, the middle channel 110*b* houses a centre finger 112*b* and a helical spring 114*b*, and the right channel 110*c* houses a right finger 112*c* and a helical spring 114*c*. The three fingers 112*a*,112*b*,112*c* are guided for sliding movement by the rigid walls of their respective channels 110*a*, 110*b*,110*c* along paths which are substantially parallel to axis Y of the handle 6. The three fingers 112*a*,112*b*,112*c* are each biased by a respective spring 114*a*,114*b*,114*c* to slide upwards and into engagement with the teeth 90*a*–90*f* of the toothed wheel 82 to lock the drill head 4 against pivotal movement relative to the handle 6. A release button 116 having three projections 118*a*,118*b*,118*c* is housed between the second support bracket 100 and the second clam shell 10 of the handle 6. The button 116 is guided for sliding movement by the internal walls of the second support bracket 100 along a path substantially parallel to axis Y of the handle 6. The button 116 is coupled to each of the three fingers 112*a*,112*b*,112*c* by a respective projection 118*a*,118*b*,118*c*. The button 116 is externally accessible through a hole 122 in the top end of the second clamshell 10 of the handle 6. The user can slide the button 116 and the three fingers 112*a*,112*b*,112*c* downward and against the bias of the three springs 114*a*,114*b*,114*c*. Alternatively, the user can release the button 116 so that bias of the three springs 114*a*,114*b*,114*c* moves the three fingers 112*a*,112*b*,112*c* and the button 116 upwardly.

The three fingers 112*a*,112*b*,112*c* and the three springs 114*a*,114*b*,114*c* form a locking member 119, and the toothed wheel 82 forms a receiving member. The locking member 119, the receiving member, and the button 116, collectively form a locking mechanism the operation of which is as follows. The locking mechanism locks the drill head 4 against pivotal movement relative to the handle 6 when the centre finger 112*b* and the left finger 112*a* abut one each side of one of teeth 90*b*–90*f* to engage said tooth therebetween, and when the centre finger 112*b* and the right finger 112*c* abut one each side of the next consecutive tooth anti-clockwise to engage said tooth therebetween. The fingers 112*a*,112*b*,112*c* can abut the sides of the teeth 90*a*–90*f* by virtue of the clearance provided by recesses 92*a*–92*g*.

In particular, the left finger 112*a* has a left ramp face 123*a* for engagement of the one of teeth 90*b*–90*f* and, the right finger 112*c* has a right ramp face 123*c* for engagement with the next consecutive tooth anti-clockwise. The left 123*a* and right 123*c* ramp faces are inclined upwardly away from the centre finger 112*b* so that the left 112*a* and right 112*c* fingers are wedge shaped at an end closest the teeth of the wheel 82. Upward movement of the left 112*a* and right 112*c* fingers progressively reduces the clearance, or play, between the left 123*a* and right 123*c* ramp faces and a respective tooth of teeth 90*a*–90*f*. Further upward movement of the three fingers 112*a*,112*b*,112*c* causes the left 123*a* and right 123*c* ramp faces to engage a respective tooth of teeth 90*a*–90*f*. The left 123*a* and right 123*c* ramp faces are inclined so that this engagement with a respective tooth of teeth 90*a*–90*f* urges the left 112*a* and right 112*c* fingers to splay apart in opposite lateral directions away from the centre finger 112*b*. This splaying apart is arrested when the left finger 112*a* abuts a left wall of the left channel 110*a* and the right finger 112*c* abuts a right wall of the right channel 110*c* to take up any clearance, or play, therebetween. The left 112*a* and right 112*c* fingers are now wedged between a respective tooth of teeth 90*a*–90*f* and the rigid wall of a respective channel 110*a*,110*c* so that clearance, or play, therebetween is reduced, or virtually eliminated. The locking mechanism has now fully locked the head 4 against movement with respect to the handle 6 and the wedge effect of the left 123*a* and right 123*c* ramp faces reduces, or virtually eliminates, play between the head 4 and the handle 6.

As described above, the user can operate the button 116 to slide the three fingers 112*a*,112*b*,112*c* downwardly against the bias of the three springs 114*a*,114*b*,114*c*. Downward movement of the left 112*a* and the right 112*c* fingers disengages the left 123*a* and right 123*c* ramp faces from a respective tooth 90*a*–90*f*. Further downward movement progressively increases the clearance, or play, between the left 123*a* and right 123*c* ramp faces until all three fingers 112*a*,112*b*,112*c* are fully disengaged from the respective tooth 90*a*–90*f* so that the head 4 is unlocked and can freely pivot relative to the handle 6.

Figure 12:
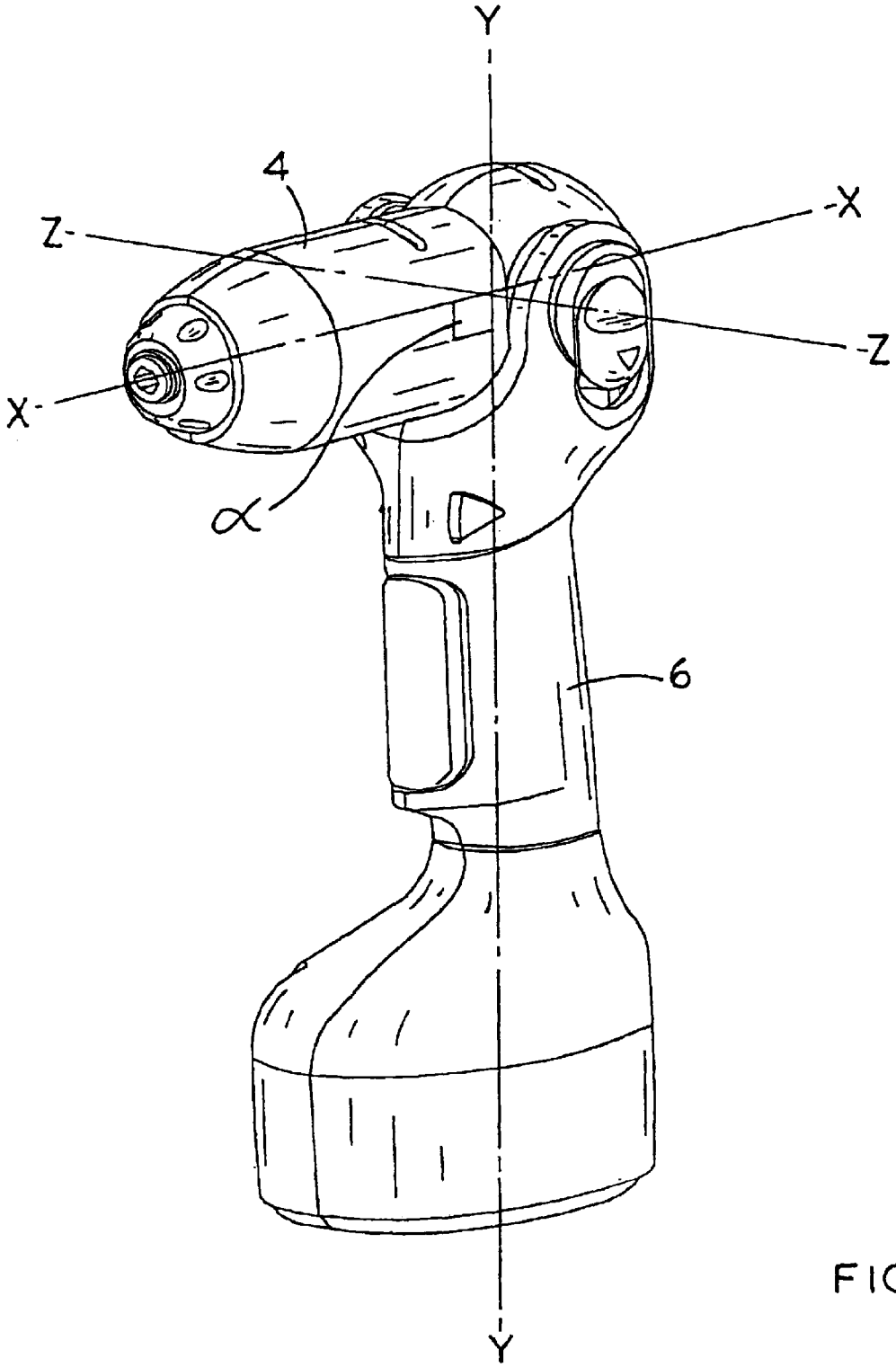
FIG. 12 shows a side perspective view of the power tool with the rotatable drill head perpendicular to the handle.
Figure 13:
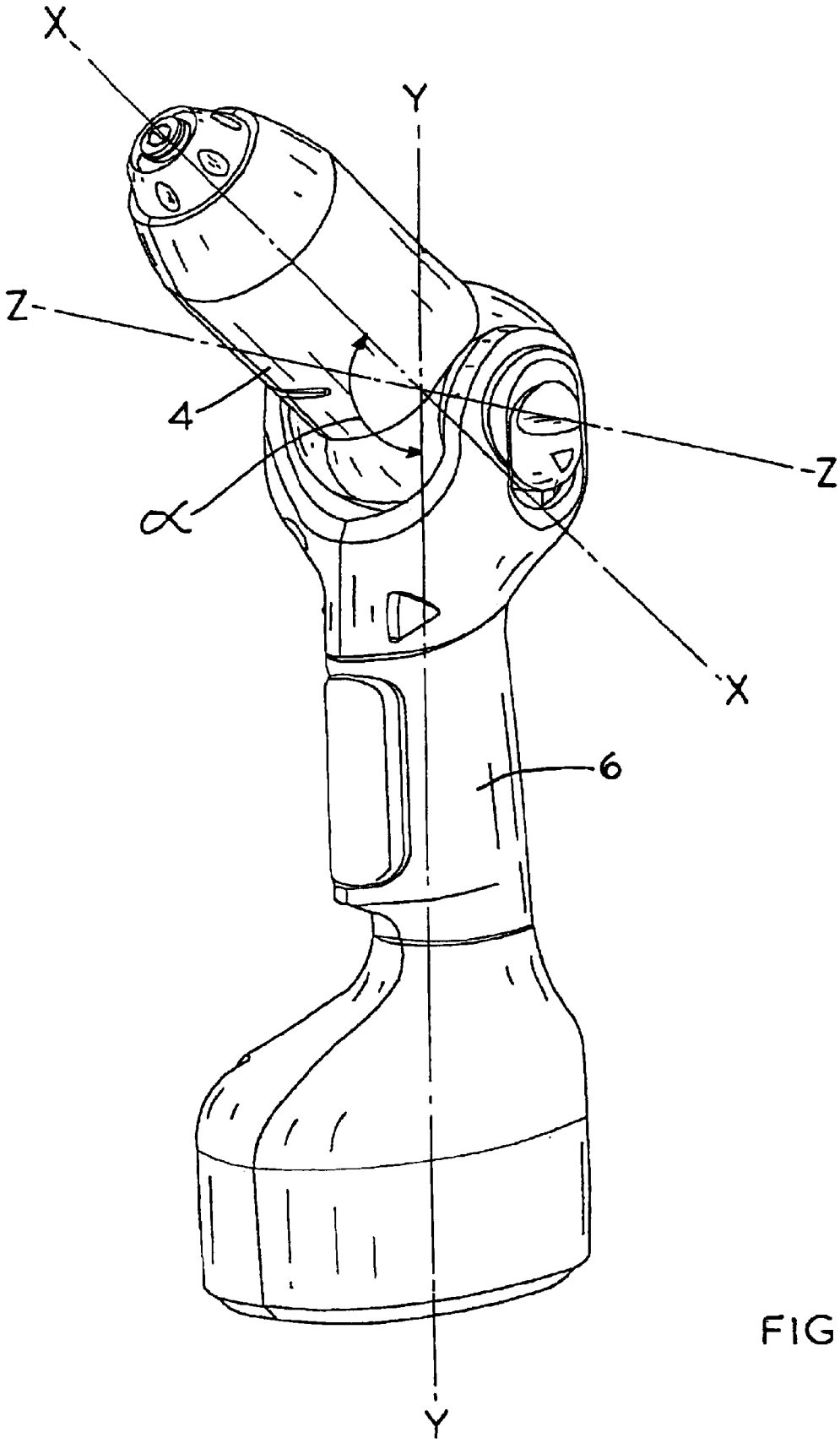
FIG. 13 shows a side perspective view of the power tool with the rotatable drill head inclined at 135° to the handle.
Figure 14:
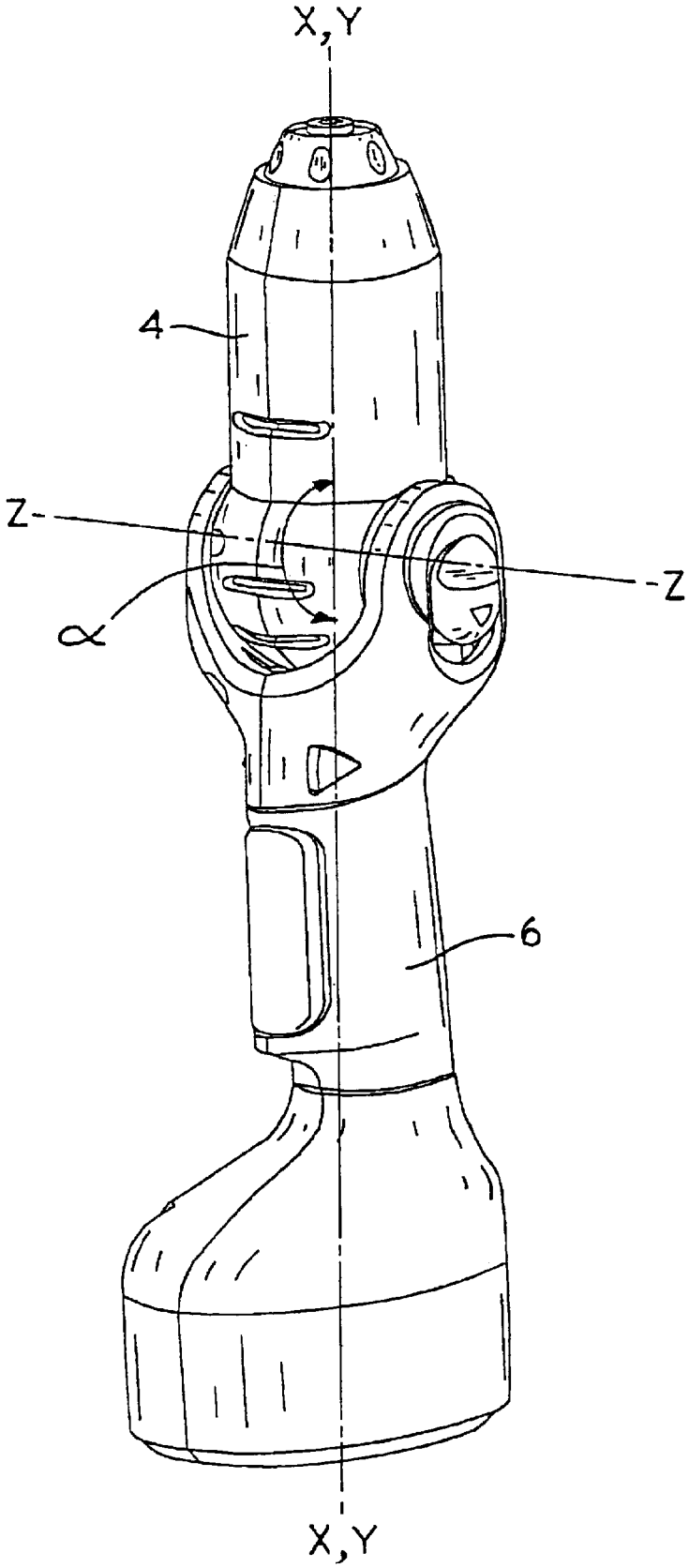
FIG. 14 shows a side perspective view of the power tool with the rotatable drill head in line with the handle.

Referring now to FIGS. 12 to 14, axis Z is the axis about which the head 4 pivots with respect to the handle 6. Axis Y represents the position of the handle 6 and axis X represents the position of the drill head 4. Both axis X and Y remain perpendicular to axis Z regardless of the orientation of the drill head 4 in relation to the handle 6. The included angle between axis X and Y is referred to as angle $\alpha$. Only angle $\alpha$ varies when the drill head 4 changes its orientation in relation to the handle 6 by pivoting about the axis Z. Angle $\alpha$ is dictated by which one of the five teeth 90*b*–90*f* engages the left ramp face 123*a* of the left finger 112*a*. Angle $\alpha$ is 90° when tooth 90*f* engages the left ramp race 123*a*, as shown in FIG. 12. Tooth 90*e* is located 45° anti-clockwise from tooth 90*f*, therefore angle $\alpha$ is 135° when recess 90*e* engages the left ramp race 123*a*, as shown in FIG. 13. Angle $\alpha$ is 180°, 225° and 270° when one of the three subsequent teeth 90*d*, 90*e*, 90*b*, respectively, engage the left ramp face 123*a*.

In the illustrated embodiment of the present invention, angle $\alpha$ can be set to five locking positions within a range of 180°, according to which one of the five teeth 90*b*–90*f* engages the left ramp face 123*a*. However, the range of angle $\alpha$ could be increased from 180° by reducing the size of the protrusion 86 and increasing the angular spacing between the six teeth 90*a*–90*f*. Also, the number of locking positions within the range of angle $\alpha$ can be varied by changing the number of teeth 90.

What is claimed is:

1. A power tool (2) comprising:

a first body (6);

a second body (4) connected to the first body (6); and a locking mechanism;

wherein one body (4;6) is moveable with respect to the other body (4;6), and the locking mechanism is capable of locking the movement of the one body (4;6) with respect to the other body (4;6), the locking mechanism comprising a two part system having a first part comprising a locking member (119) having a plurality of fingers and a second part comprising a receiving member having a plurality of teeth (82), whereby engagement between the plurality of fingers and teeth locks the first body (6) and second body (4) against movement with respect to each other, and wherein one part is moveable with respect to the other part between a first position and a second position, such that the first part plurality of fingers and the second part plurality of teeth are engaged when that one part is in the first position, and the first part plurality of fingers and the second part plurality of teeth are disengaged when that one part is in the second position, and at least one of the fingers or teeth is shaped to cause take up of play between the two parts of the locking mechanism when that one part moves into the first position.

2. A power tool (2) as claimed in claim 1, wherein one body (4;6) is rotatable with respect to the other body (6) about a pivot axis (z).

3. A power tool (2) as claimed in claim 2, wherein the locking member (119) plurality of fingers comprises a left finger **(112*a*) with a left ramp face (123*a*) for engagement with the receiving member (82), and a right finger (112*c*) with a right ramp face (123*c*) for engagement with the receiving member (82) plurality of teeth, and wherein the ramp faces (123*a*; 123*c*) are inclined with respect to the receiving member (82) such that the movement of that one part into the first position takes up play between the left ramp face (123*a*) and the receiving member (82) plurality of teeth, and the movement of that one part into the first position takes up play between the right ramp (123*c*) face and the receiving member (82)** plurality of teeth.

4. A power tool (2) as claimed in claim 3, wherein the left finger **(112*a*) is arranged in a left channel (110*a*) and the right finger (112*c*) is arranged in a right channel (110*c*), such that the movement of that one part into the first position wedges the left finger (112*a*) between the receiving member (82) plurality teeth and a wall of the left channel (110*a*), and the movement of that one part into the first position wedges the right finger (112*c*) between the receiving member (82) plurality of teeth and a wall of the right channel (110*c*)**.

5. A power tool (2) as claimed in claim 4, wherein the left **(110*a*) and right (110*c*) channels are fixed to the first body (6), and the receiving member (82) plurality of teeth are fixed to the second body (4)**.

6. A power tool (2) as claimed in claim 4, wherein the left finger **(112*a*) moves in the left channel (110*a*) between the first position and the second position, and the right finger (112*c*) moves in the right channel (110*c*)** between the first position and the second position.

7. A power tool (2) as claimed in claim 6, wherein the left **(112*a*) and right (112*c*) fingers are biased towards the first position by a respective resilient member (114*a*; 114*c*)**.

8. A power tool (2) as claimed in claim 3, wherein the receiving member is a wheel (82) having the pivot axis (z) and said plurality of teeth.

9. A power tool (2) as claimed in claim 8, wherein the plurality of teeth **(90*a*–90*f*) are arranged about the circumference of the wheel (82) for engagement with the ramp faces (123*a*; 123*c*)**.

10. A power tool (2) as claimed in claim 9, wherein the locking mechanism further comprises a button (116) coupled to the left **(112*a*) and right (112*c*)** fingers.

* * * * *